US006082259A

United States Patent [19]

Siegenthaler et al.

[11] Patent Number: 6,082,259

[45] Date of Patent: Jul. 4, 2000

[54] TURNING TOWER ARRANGEMENT

[75] Inventors: Hansulrich Siegenthaler, Brenzikofen; Markus Flückiger, Signau, both of Switzerland

[73] Assignee: Maschinenfabrik Wifag, Switzerland

[21] Appl. No.: 09/108,671

[22] Filed: Jul. 1, 1998

[30] Foreign Application Priority Data

Jul. 2, 1997 [DE] Germany ..... 197 28 207

[51] Int. Cl.[7] ..... B41F 13/56

[52] U.S. Cl. ..... 101/227; 270/20.1; 101/228

[58] Field of Search ..... 101/219, 225, 101/227, 228, 485; 226/196.1, 189

[56] References Cited

U.S. PATENT DOCUMENTS

| | | | |
|---|---|---|---|
| 3,819,172 | 6/1974 | Santalla | 270/41 |
| 3,948,504 | 4/1976 | Woessner et al. | 270/41 |
| 4,052,048 | 10/1977 | Shirasuka | 270/40 |
| 4,063,505 | 12/1977 | Sasamoto et al. | 101/228 |
| 4,147,104 | 4/1979 | Zernov et al. | 101/228 |
| 4,190,242 | 2/1980 | Bolza-Schunemann | 270/42 |
| 4,385,716 | 5/1983 | De Roeck et al. | 101/228 |
| 4,538,517 | 9/1985 | Michalik et al. | 101/227 |
| 4,925,170 | 5/1990 | Weis | 270/20.1 |
| 5,052,296 | 10/1991 | Shiba | 101/228 |
| 5,088,403 | 2/1992 | Shoji et al. | 101/227 |
| 5,119,725 | 6/1992 | Okamura | 101/226 |
| 5,121,910 | 6/1992 | Hajer et al. | 270/10 |
| 5,397,044 | 3/1995 | Suzaki | 101/228 |
| 5,458,062 | 10/1995 | Goldberg et al. | 101/226 |
| 5,647,582 | 7/1997 | Shiba | 270/8 |
| 5,813,337 | 9/1998 | Peters et al. | 101/228 |
| 5,906,307 | 5/1999 | Albert et al. | 226/109 |

FOREIGN PATENT DOCUMENTS 296 17 976 U1 2/1997 Germany .

*Primary Examiner*—Eugene Eickholt
*Attorney, Agent, or Firm*—McGlew and Tuttle, P.C.

[57] ABSTRACT

A turning tower arrangement for a printing press includes a turning tower (11) with turning bars (21, 22) arranged in a plurality of planes (E1–E12) one over the other for guiding printed webs one over the other. A first turning tower (11) and at least one second turning tower (12) are arranged directly one behind the other in the direction of a printed web entering one of the two turning towers (11, 12).

20 Claims, 8 Drawing Sheets

TURNING TOWER ARRANGEMENT

FIELD OF THE INVENTION

The present invention pertains to a turning tower arrangement for a printing press, especially for the offset printing of newspapers.

BACKGROUND OF THE INVENTION

The requirements on the flexibility of printing presses have been increasing with the increasing variety of newspaper and magazine products. The press must be able to be changed over from one production to the next as rapidly as possible if the product as a whole must be changed or if only part, e.g., the regional parts within a supraregional newspaper, must be changed within a product.

Turning bar attachments, which are used especially for feeding printed webs to be folded lengthwise over one another, must promote this flexibility.

A reversible turning tower has been known from DE 296 17 976 U1. The tower is divided in two vertically. The turning bars are mounted in two carriages arranged one over the other, which are displaceable in a frame of the tower at right angles to the direction of intake of the web between two end positions, from which the webs, guided one over the other, exit into respective formers arranged downstream.

SUMMARY AND OBJECTS OF THE INVENTION

The object of the present invention is to provide a turning tower arrangement, with which the variety of products and frequent product changeovers can be handled in a flexible manner and which nevertheless has a simple design.

According to the invention, a turning tower arrangement for a printing press is provided wherein the arrangement comprises a turning tower with turning bars arranged in a plurality of planes for guiding printing webs one over the other. A first turning tower and at least one second turning tower are arranged one behind the other in the direction of a printed web entering one of the two turning towers.

The present invention is based on a turning tower arrangement, which comprises a turning tower, in which turning bars are arranged in a plurality of planes one over the other in order to guide a plurality of printed webs or partial printed webs one over the other. The webs guided one over the other are, in general, led subsequently through a former, are folded lengthwise there, cut crosswise in a folder arranged downstream, and delivered as a finished printed product.

The turning tower arrangement according to the present invention has at least two turning towers, which are arranged directly one behind the other in the direction of a web entering one of the two turning towers. There are, in particular, no printing mechanisms between the two turning towers.

Two webs entering one of the towers may be led one over the other already in this turning tower; however, both may also be led through this first turning tower into the second turning tower arranged directly behind same and be guided one over the other there. They may also be passed through the second turning tower and returned in the opposite direction through the second turning tower, deflected around guide rollers of the second turning tower, and, thus reversed, they may already be led one over the other in the second turning tower or in the first turning tower. Finally, one of the two webs may be guided one over the other with a plurality of webs in a suitable manner in the first turning tower, and the other of the two webs in the second turning tower. The variability in terms of the webs to be guided one over the other and thus ultimately also in terms of the finished printed product or products is considerably increased compared with prior-art single turning towers.

The turning tower arrangement according to the present invention is preferably arranged between two printing towers of the printing press, so that the printed webs enter the turning tower arrangement from both sides and can be guided one over the other there as was described above. If at least one former each is also arranged on both sides of each turning tower of the turning tower arrangement, which corresponds to another preferred embodiment, it is already possible to process four strands of webs guided one over the other into 2, 3 or even 4 finished printed products, depending on whether the strands of web folded lengthwise are subjected to further processing one by one behind the formers or are led one over the other once again in a suitable manner.

As in the usual turning tower arrangements as well, cutting means for longitudinally cutting webs entering the turning tower arrangement in the direction of the arriving web are arranged in front of the individual turning towers when viewed in the direction of the arriving web. However, as a consequence of the arrangement of at least two turning towers with such cutting means according to the present invention, one cutting means of one tower may also be used as a cutting means for a web that enters the other tower and is led through that other tower.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
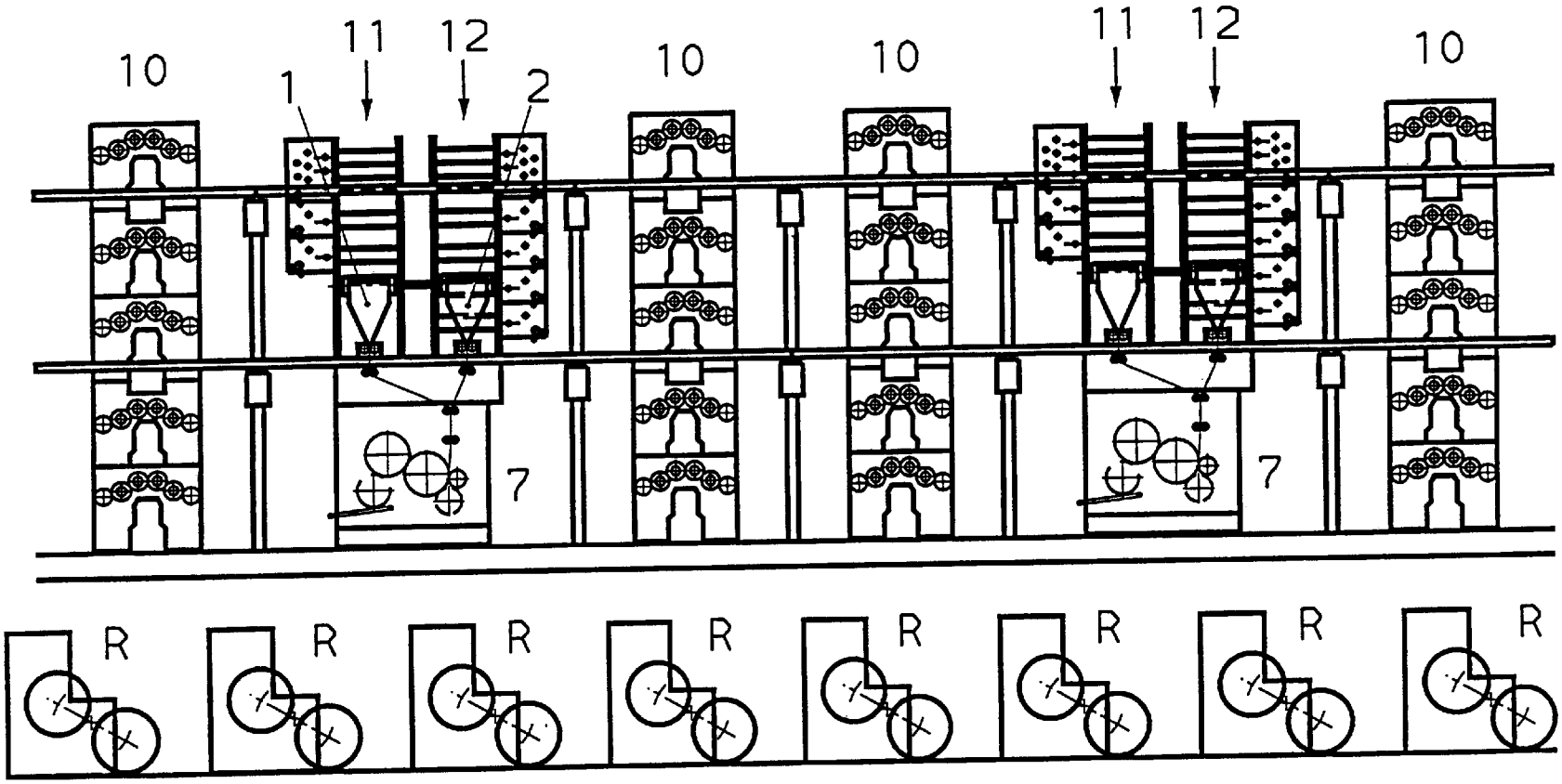
FIG. 1 is a web-fed printing press with a first exemplary embodiment for a turning tower arrangement according to the present invention.

Referring to the drawings in particular, a web-fed rotary printing press is provided as shown in FIG. 1. The printing press has a plurality of printing towers 10, in which five printing mechanisms each are arranged one over the other for multicolored, two-sided printing. If the press is a preferred four-color printing press, all four colors can be printed in each of the printing towers, while the fifth printing mechanism is kept in stand-by in order to form a print position for the next production in the case of, e.g., a production change in the course of a flying plate change. A number of roller changers R, whose number corresponds to the number of the printing towers 10, are arranged in a roller cellar under the plane of the printing tower, i.e., one or more roller changers R can be associated with one printing tower 10.

Folders 7 are arranged between the printing towers 10 in the plane of the printing tower. Turning tower arrangements, to which printed webs are fed from the printing towers 10, especially from the two printing towers 10 located adjacent to the turning tower arrangement, and in which the partial printed webs are guided one over the other after an optional lengthwise cutting, are located in a plane above the folders 7. The exiting strands of web are folded lengthwise in adjoining formers 1 and 2. The strands of web folded lengthwise are brought together behind the formers, cut crosswise in the folders 7 and folded, and finally removed from the folders 7 as finished printed products sheet by sheet.

Each of the turning tower arrangements is formed by two turning towers 11 and 12. The two turning towers 11 and 12, hereinafter called first turning tower 11 and second turning tower 12, are arranged directly behind one another—directly next to one another in the plane of the sheet in FIG. 1—in the direction of the webs entering the turning tower arrangement. In the position of the turning tower arrangement 11, 12 shown in FIG. 1, there are printing towers 10 on both sides of the turning tower arrangement 11, 12. Printed webs can thus enter the turning tower arrangement 11, 12, coming from the left-hand printing tower 10 or from a plurality of left-hand printing towers 10 over the first turning tower 11 or from the right-hand printing tower 10 or from a plurality of right-hand printing towers 10 and they can be guided there in a suitable manner one over the other either in the first turning tower 11 or in the second turning tower 12.

Viewed in the plane of the sheet of FIG. 1, four printing towers 10 are followed by one turning tower arrangement 11, 12 in the exemplary embodiment. The two nearest printing towers 10 arranged to the left and right of each turning tower arrangement 11, 12 preferably work on their turning tower arrangement 11, 12 arranged centrally therebetween in the plane of the sheet of FIG. 1. However, the assignment of printing towers 10, on the one hand, and turning tower arrangements 11, 12, on the other hand, may be performed, in principle, adapted to the particular production or productions.

Figure 2:
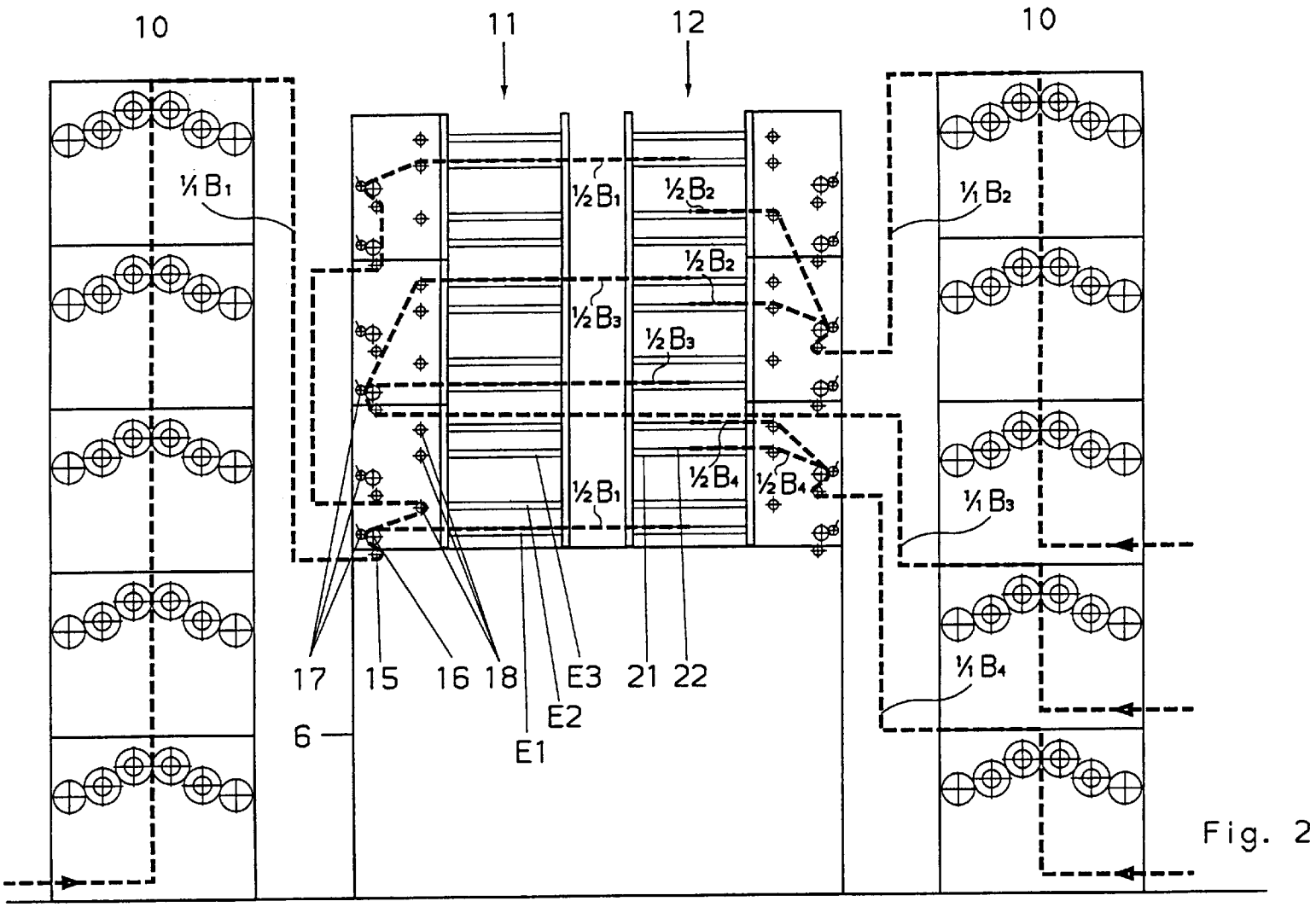
FIG. 2 is the turning tower arrangement according to FIG. 1, in which printed webs for a first printed product are guided one over the other in one of the towers.

FIG. 2 shows the turning tower arrangement 11, 12 according to FIG. 1 together with the printing towers 10 located directly on both sides of the turning tower arrangement 11, 12. In the production shown, one printed web B1, the width of four plates, runs from the left-hand printing tower 10 first into the first turning tower 11 that directly follows that printing tower 10, and three printed webs B2, B3 and B4, the width of four plates, run from the right-hand printing tower 10 first into the second turning tower 12 that directly follows that right-hand printing tower. The web B1 from the topmost printing mechanism of the left-hand printing tower 10 is led up to under the first, lowermost plane E1 of the first turning tower 11 via guide members, not shown. It is deflected there around a guide roller 15, which is adjacent to a draw roller 16, in order to thus achieve a sufficient looping around the draw roller 16, then guided around the draw roller 16 and cut in the process lengthwise by means of a circular knife 17 adjusted to the draw roller 16. The top side of the draw roller 16 is located in the first turning bar plane E1. A first partial web, the width of two plates, is delivered unhindered through the first turning tower 11 by the draw roller 16 in the first turning bar plane E1 and is introduced into the second turning tower 12 in the same plane E1, is turned at right angles to the direction of intake there, optionally also reversed and is subsequently removed from the second turning tower 12 to a next former in the new direction at right angles to the direction of intake. The second partial web, which was formed from B1 by the lengthwise cutting, is led to a turning bar plane E11 of the first turning tower 11, which plane E11 is located above the first turning bar plane E1 via a plurality of guide members. In plane E11, it is likewise led unhindered through the first turning tower 11 into the second turning tower 12 located in the same plane E11, turned in a suitable manner and optionally reversed and is removed from the second turning tower 12 to a next former at right angles to the direction of intake. The former may be the same former to which the other partial web formed from B1 is also delivered. Since at least one former each is preferably provided on both sides of each turning tower 11 and 12 when viewed in the direction of exit of the webs, the two partial webs formed from B1 may also be fed to one of these two formers on the sides of the second turning tower 12.

Each of the turning towers 11 and 12 has turning bars 21 and 22 arranged vertically one over the other in 12 planes E1 through E12. A plurality of turning bars 21 are arranged in each of the planes E1 through E12 in parallel one over the other, and a plurality of turning bars 22 are in turn arranged crosswise thereto, the latter turning bars being arranged in parallel next to one another, as can be better recognized from FIG. 5. The number of turning bars arranged in parallel or crosswise next to one another, both 21 and 22, is a maximum of four turning bar pairs for the printing press having the width of four plates and six turning bar pairs for a printing press having the width of six plates.

At least one turning bar pair is arranged crossed or in parallel per turning bar plane E1 through E12, and the turning bars (21, 22) may be arranged vertically offset among each other.

In the design shown in FIGS. 1 through 6 with two turning towers 11 and 12 with 12 turning bar planes E1 through E12 each and with at least one former each per turning tower 11 and 12 on the same side of the turning tower arrangement 11, 12, the 12 two-sided webs of a 24-page printed product can be guided one over the other per turning tower. Due to the two strands of web folded lengthwise being brought together once again behind the formers 1, 2 or 3, 4, a printed product that is maximal for the turning tower arrangement according to FIGS. 1 through 6 is formed. The design of the turning tower arrangement is also suitable for presses having the width of six plates, besides for printing presses having the width of four plates. The arrangement of two turning towers (11, 12) is meaningful if there are at least two webs.

A plurality of lengthwise cutting means 16, 17 are arranged one over the other in front of the first turning tower 11 and in front of the second turning tower 12 when viewed in the direction of run from the respective adjacent printing tower 10. Furthermore, each of the turning bar planes E1 through E12 is directly preceded by a guide member, via which the web in question or the partial web in question is guided into the corresponding plane E1 through E12. These guide members, which are located in the planes E1 through E12 with their top sides, are formed either by simple guide rollers 18 or by draw rollers 16 of the lengthwise cutting means 16, 17. Even though guide rollers for deflecting webs led through the turning tower may also be provided between the turning towers 11 and 12, this is not necessary. Due to the arrangement of two turning towers according to the present invention, a web entering one of the turning towers, which shall be again led out of that turning tower reversed, can be simply led first through both turning towers and be deflected around the guide members 15, 16 and 18 of the respective other turning tower, which guide members are present on the outsides of the turning tower arrangement 11, 12, it can be returned through the other turning tower to the turning tower which it had originally first entered, and from which it shall exit reversed. This is shown in FIG. 2 based on the example of web B3 from the right-hand printing tower 10.

Web B3 is delivered into the second turning tower 12 following the right-hand printing tower 10 and is first led simply unhindered through both turning towers 12 and 11, deflected via a draw roller 16 of the first turning tower 11 and is cut lengthwise by means of the circular knife 17 adjusted to that draw roller 16. The draw roller 16 also acts at the same time as a guide member for the plane E5, in which the partial web formed from B3, which is turned over over the draw roller 16, leaves the second turning tower, turned over again, after being led through the first turning tower. The other partial web formed from B3 also leaves the second turning tower 12, turned over twice. The guide members of the first turning tower, namely, the draw rollers 16 and the guide rollers 18, act with respect to these two partial webs formed from B3 as in bay window devices known from prior-art turning towers. Furthermore, the cutting means 16, 17 of the first turning tower 11 is used as a cutting means for the second turning tower 12.

Figure 3:
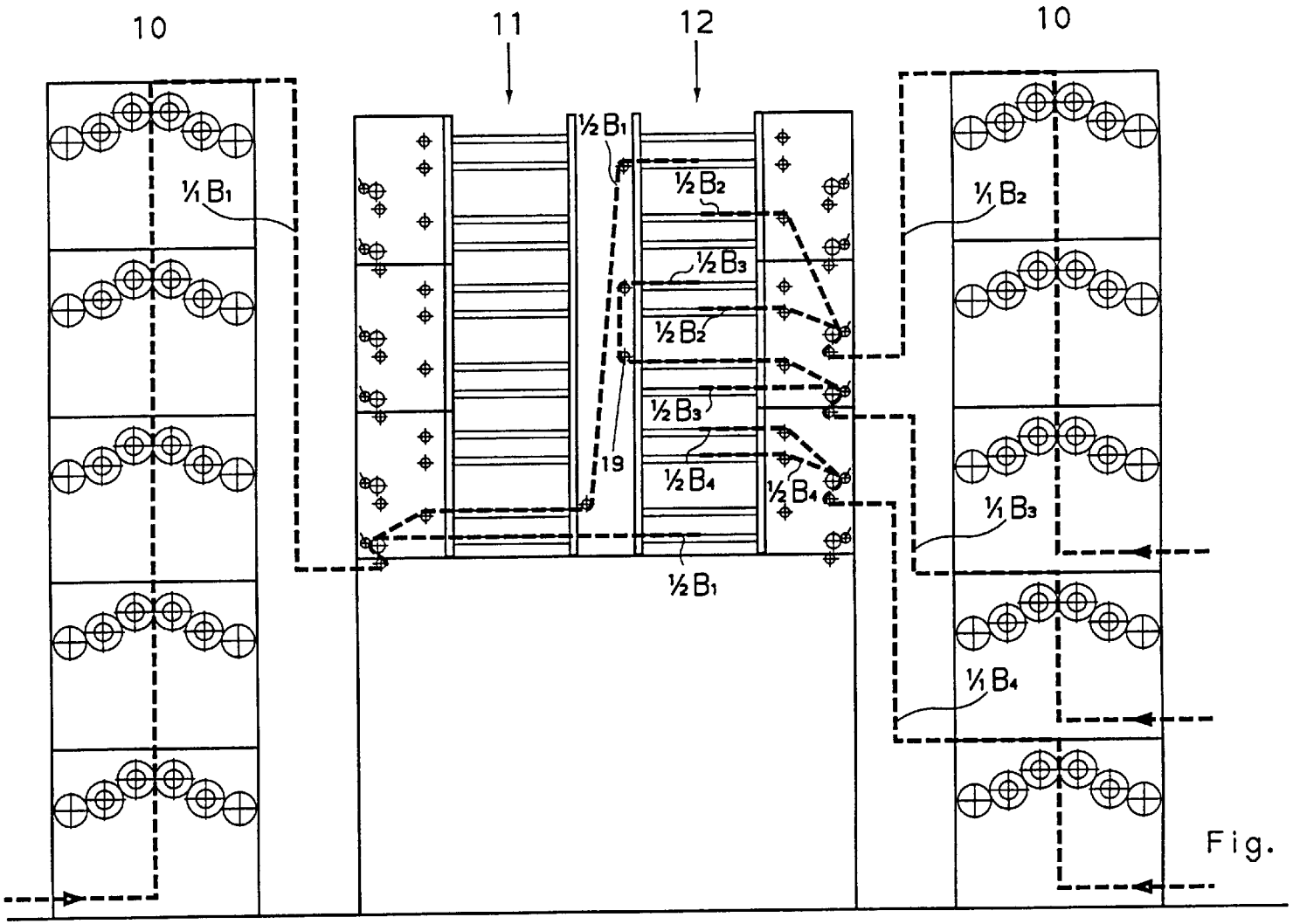
FIG. 3 is the turning tower arrangement according to FIG. 1, in which printed webs for a second printed product are guided one over the other in one of the towers.

In the case of the alternative guiding of the two webs B1 and B3 shown in FIG. 3, the lower of the two partial webs formed from B3 is turned over only once, while the top partial web formed from B3 is guided over two guide rollers 19 of the second turning tower 12, which are arranged between the two turning towers 11 and 12, to a higher level E8 of the second turning tower and is turned over in the process, so that it leaves the second turning tower 12 after being turned over once again in the turning bar plane E8. Since the upper of the two partial webs formed from B3 is turned over by the two guide rollers 19 of the second turning tower 12, which act as bay window devices, the somewhat simplified web guiding of the upper partial web formed from B1 in FIG. 3 compared with FIG. 2 is possible. The strand of web leaving the second turning tower 12 differs from that shown in FIG. 2 in that the lower partial web formed from B3 has been turned over only once.

Figure 4:
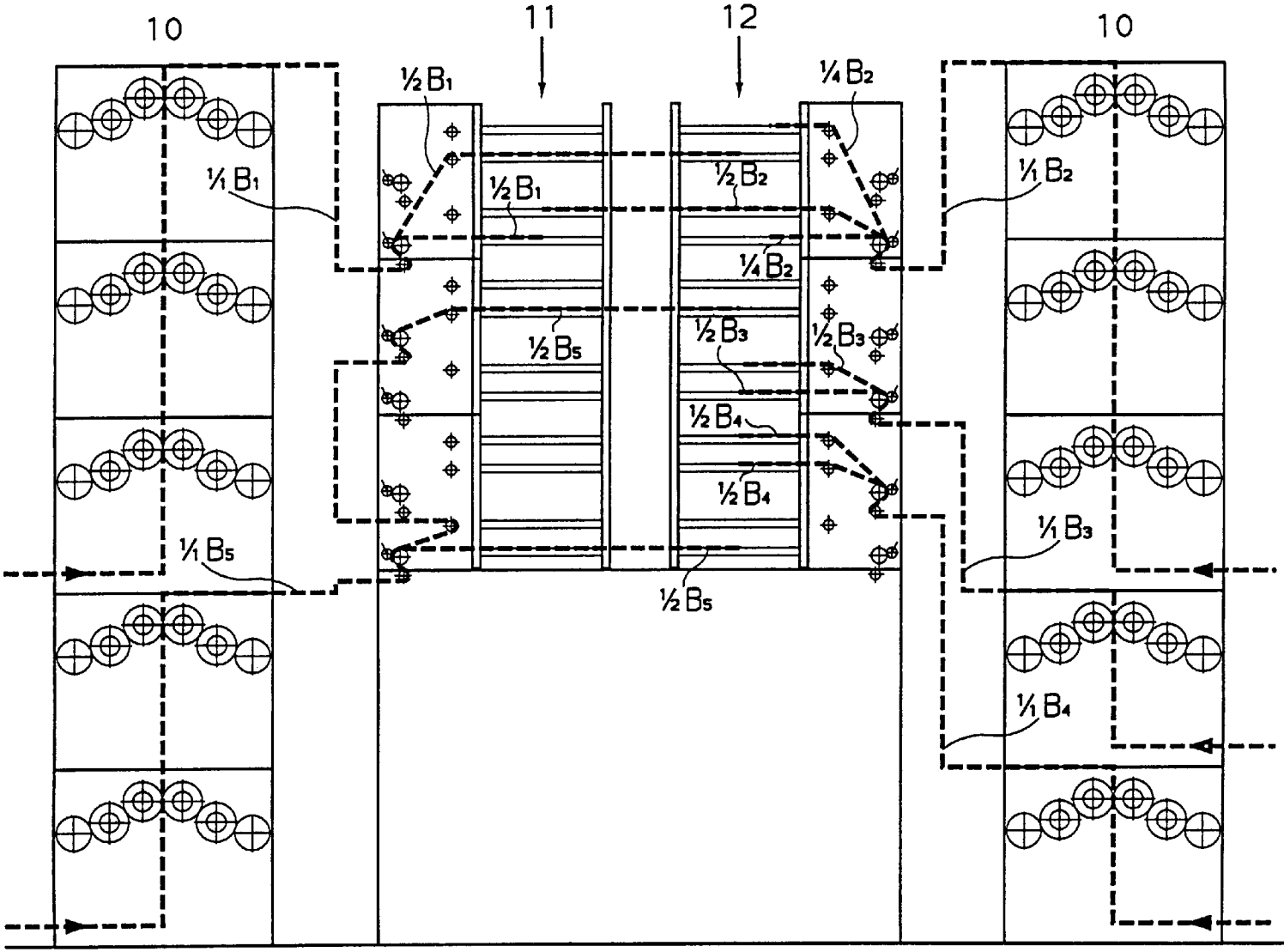
FIG. 4 is the turning tower arrangement according to FIG. 1, in which the printed webs are guided one over the other in both turning towers.

FIG. 4 shows a production example in which webs are guided one over the other in both a first turning tower 11 and a second turning tower 12. It can be recognized, in particular, how partial webs formed from the webs B1 and B5 are led through the first turning tower 11 that directly follows that printing tower 10 to the second turning tower 12 and are guided over additional partial webs formed from the webs B2, B3 and B4 from the right-hand printing tower there. Likewise, one of the partial webs formed from B2 is delivered from the right-hand printing tower through the second turning tower 12 into the first turning tower 11 and is guided over one of the partial webs from the left-hand printing tower. This mutual guiding of printed webs one over the other, i.e., from the left-hand printing tower 10 to the right-hand, second turning tower 12 and from the right-hand printing tower 10 to the left-hand, first turning tower 11, considerably increases the flexibility with which printed webs can be guided over one another in terms of the variety of production and the possibility of changeover.

Five full webs are cut into ½ and ¼ webs lengthwise in the exemplary embodiment according to FIG. 4 and the partial webs thus formed are brought together into two strands of web, one strand of web per turning tower, in the manner shown.

Figure 5:
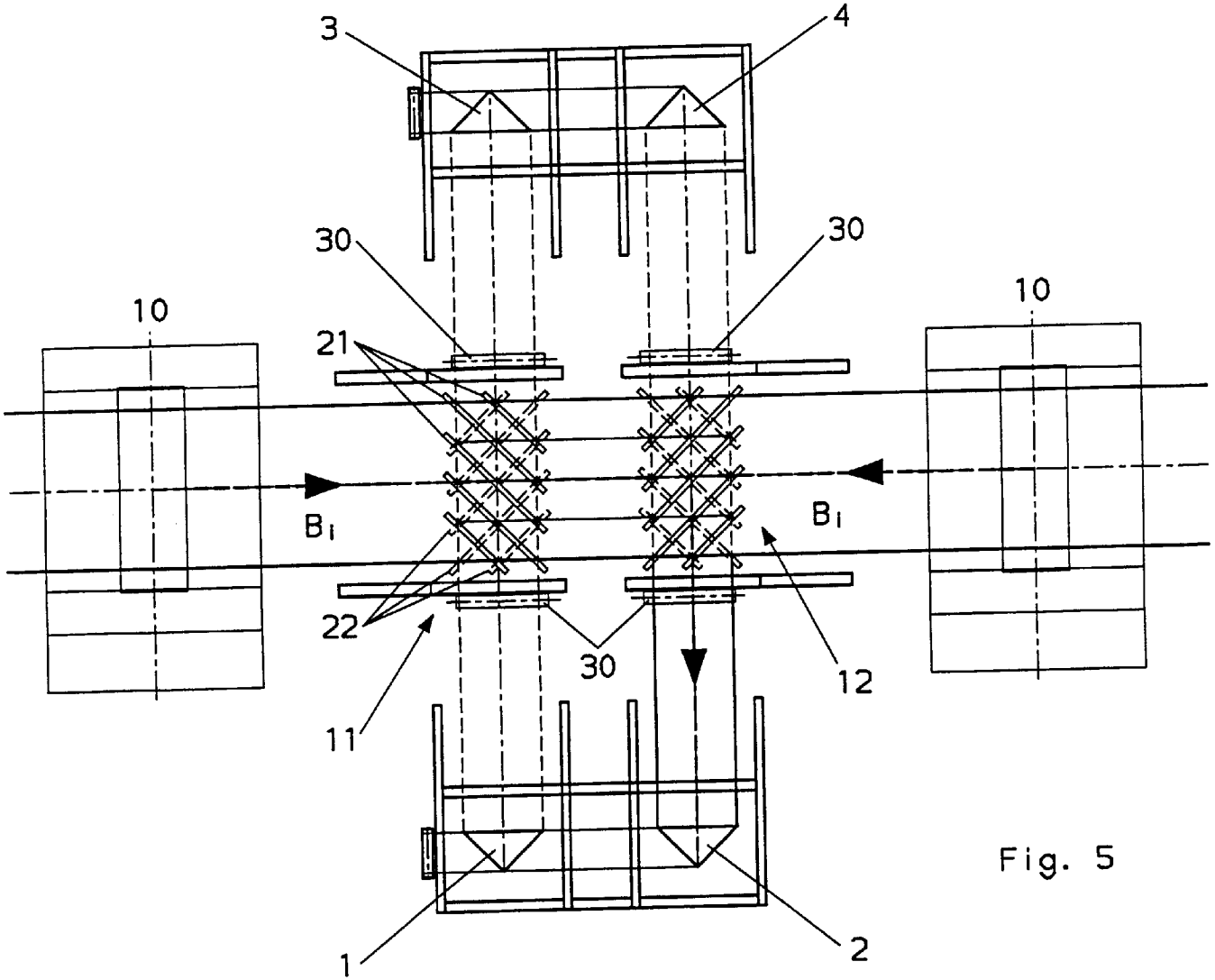
FIG. 5 is a top view of the turning tower arrangement according to FIGS. 1 through 4.

FIG. 5 shows the top view of the turning tower arrangement according to FIGS. 1 through 4. The two turning towers 11 and 12 are followed by formers 1, 2, 3 and 4 in both directions of web exit. Furthermore, a number of guide rollers 30, whose number corresponds to the number of turning bar planes E1 through E12, and which, acting as bay window devices, are able to return the webs turned over in the area of the turning bars into the area of the turning bars, turning them once more, are arranged one under the other on both sides of the turning towers 11 and 12. One folder 7 (FIG. 1) each is arranged under the two former pairs 1, 2 and 3, 4.

Figure 6:
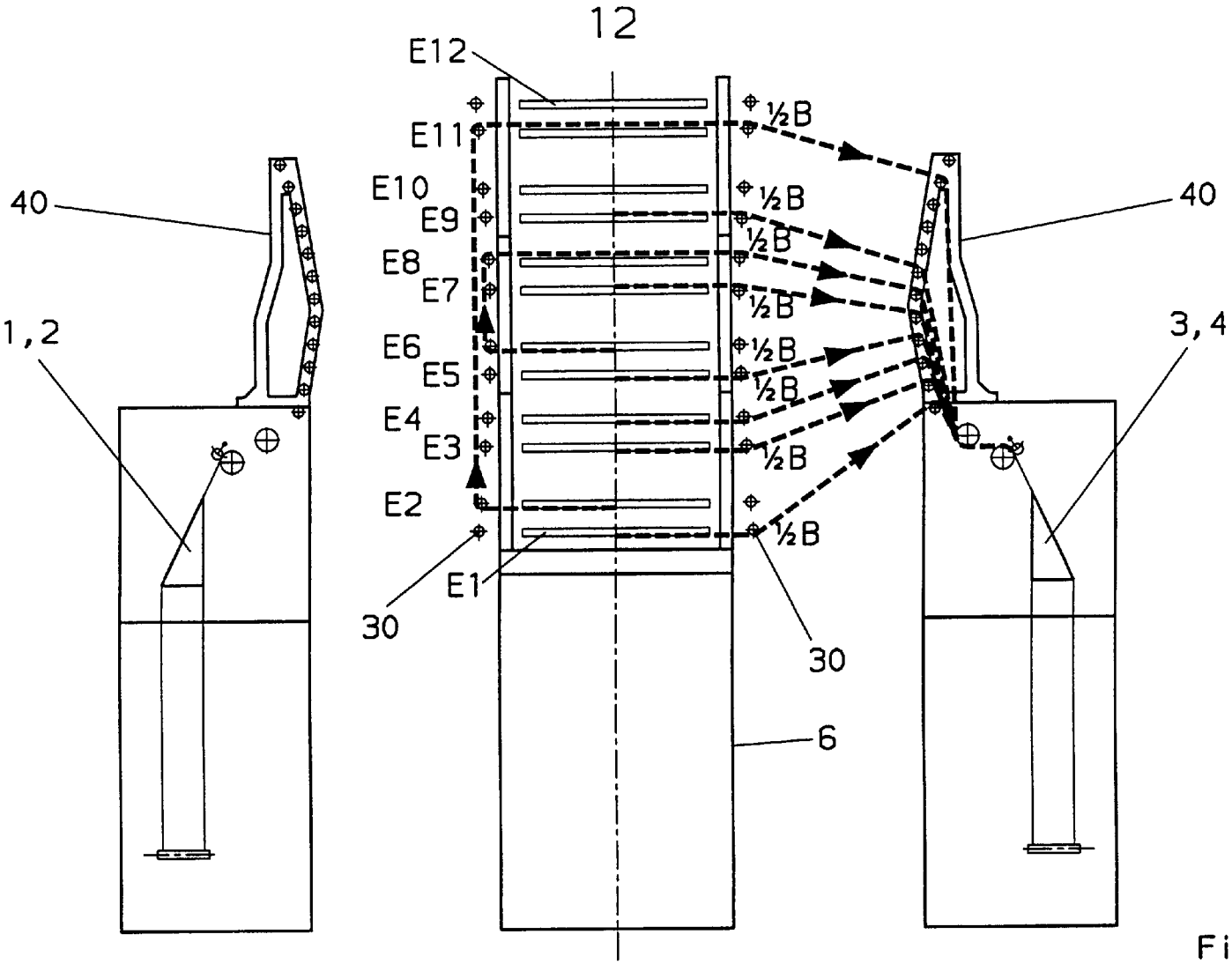
FIG. 6 is a view of the turning tower arrangement according to FIGS. 1 through 5 in the plane of the exiting webs.

FIG. 6 shows the turning tower arrangement according to FIGS. 1 through 5 in a view from the arriving web. The partial webs guided one over the other leave the second turning tower 12 shown via the guide rollers 30, while they are deflected under or over the exit-side guide rollers 30 and are brought together by means of a fan 40, which is equipped with additional guide rollers 41 in order to subsequently enter the former 3, 4 from the top via a former roller and an additional draw roller. The arrangement of the opposite formers 1, 2 corresponds to that of the formers 3, 4.

Figure 7:
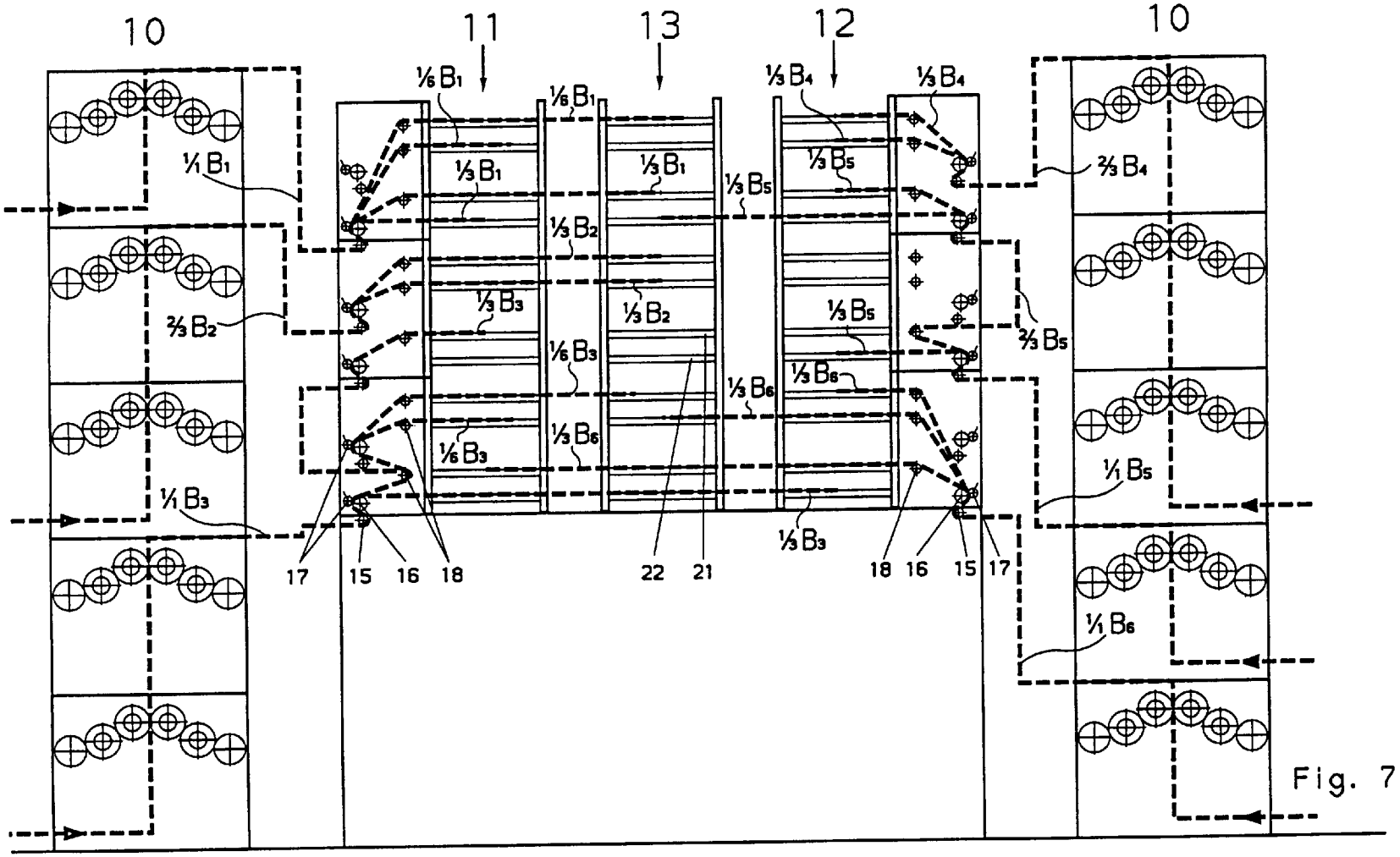
FIG. 7 is a second exemplary embodiment for a turning tower arrangement according to the present invention with three turning towers arranged one behind the other in the direction of movement of the web.

FIG. 7 shows an expanded turning tower arrangement with the first turning tower 11, the second turning tower 12 and a third turning tower 13 arranged between these two. All three turning towers 11, 12 and 13 have the same design in terms of their turning bars 21 and 22. The turning towers 11 and 12 correspond to those according to FIGS. 1 through 6. No separate cutting means 16, 17 is provided for the third turning tower 13 only. The cutting means 16, 17, which are arranged on the sides of the first turning tower 11 and the second turning tower 12, which sides face away from one another, are used for the partial webs to be guided one over the other in this third turning tower 13.

Six webs are cut lengthwise in the exemplary embodiment according to FIG. 7, and the partial webs thus formed are guided over one another to three strands of web, one strand of web per turning tower, in the manner shown.

Figure 8:
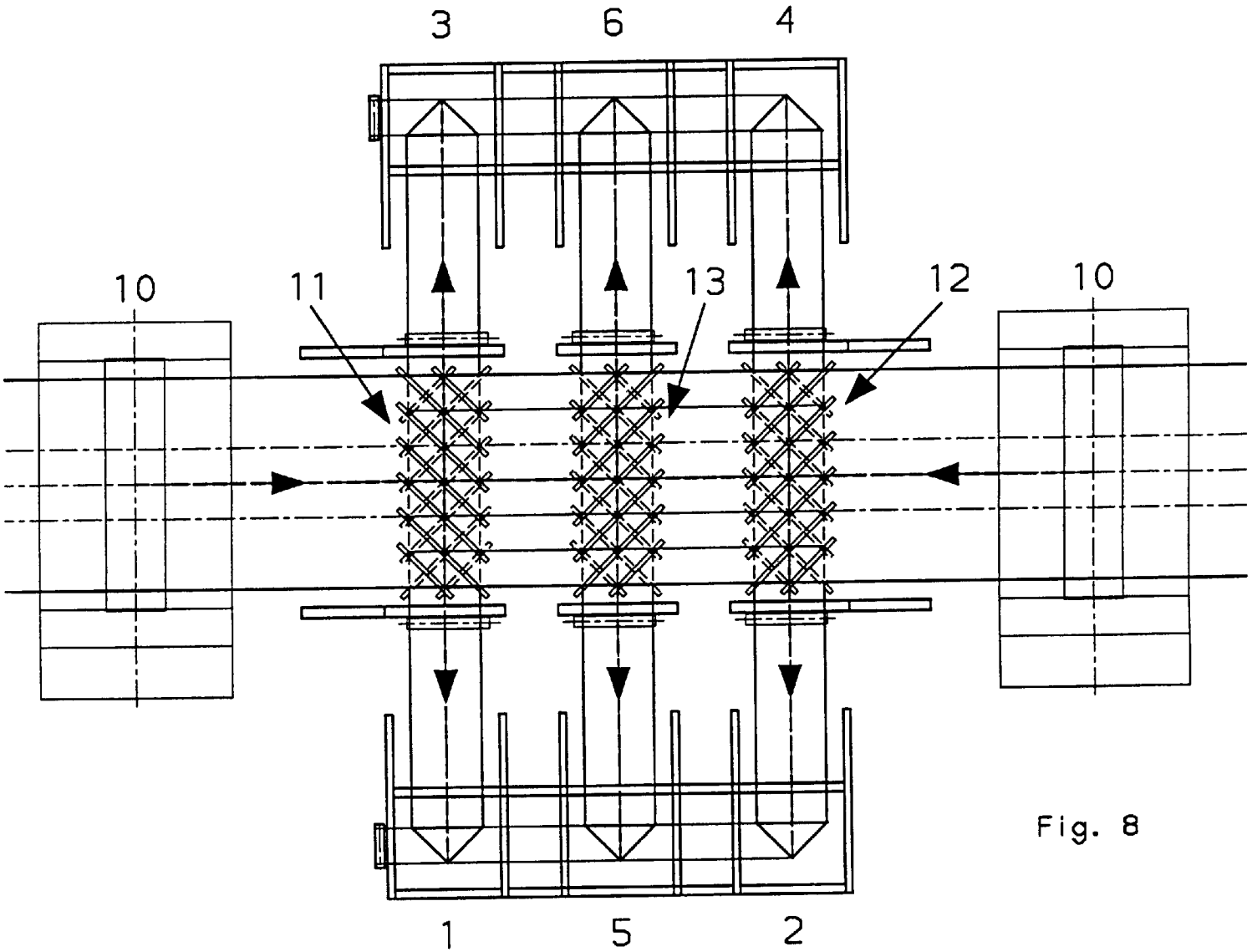
FIG. 8 is a top view of the turning tower arrangement according to FIG. 7.

As is apparent from the top view in FIG. 8, each of the turning towers 11, 12 and 13 is followed on each web exit side by at least one former 1, 3 and 2, 4 as well as 5, 6. There is one folder under both former rows 1, 2 and 5 as well as 3, 4 and 6.

While specific embodiments of the invention have been shown and described in detail to illustrate the application of the principles of the invention, it will be understood that the invention may be embodied otherwise without departing from such principles.

What is claimed is:

1. A turning tower arrangement for a printing press, the arrangement comprising:

a turning tower with a plurality of turning bars, said turning bars being arranged in a plurality of turning bar levels for guiding printing webs one over the other, one of said printing webs running into said turning tower in a first direction;

another turning tower, with a plurality of another turning tower turning bars arranged in a plurality of levels, said another turning tower being arranged with respect to said turning tower one behind the other along said first direction.

2. The turning tower arrangement in accordance with claim 1, further comprising at least one guide member arranged on a side of said another turning tower facing away from said turning tower in a direction of web intake, said at least one guide member being provided as a bay window device for said turning tower.

3. The turning tower arrangement in accordance with claim 1, further comprising cutting means for the lengthwise cutting of the web provided, on at least one of the sides of the turning towers which face away from one another.

4. The turning tower arrangement in accordance with claim 1, further comprising a further turning tower arranged between said turning tower and said another turning tower in a direction of web intake.

5. The turning tower arrangement in accordance with claim 3, wherein said cutting means is arranged in front of said respective turning tower and said another turning towers in the direction of web entry for cutting the web lengthwise.

6. The turning tower arrangement in accordance with claim 5, further comprising guide members arranged on a side of said another turning tower facing away from said turning tower in a direction of web intake.

7. The turning tower arrangement in accordance with claim 6, further comprising a further turning tower arranged between said turning tower and said another turning tower in a direction of web intake, said guide members for the webs to be guided one over the other in said further turning tower.

8. The turning tower arrangement in accordance with claim 1, wherein said turning tower and said another turning tower are followed by at least one former each in a direction of the webs leaving the associated tower.

9. The turning tower arrangement in accordance with claim 1, wherein at least one of said turning tower and said another turning tower has turning bar levels whose number is at least sufficient for guiding all partial webs formed from a web having the maximum width for the particular printing press one over the other.

10. The turning tower arrangement in accordance with claim 1, wherein for a printing press having the width of four plates:

a) at least two printed webs enter the turning tower arrangement; and b) each of said turning tower and said another turning tower has at least four said turning bar levels.

11. The turning tower arrangement in accordance with claim 1, wherein for a printing press having the width of six plates:

a) at least two printed webs enter the turning tower arrangement; and b) each of said turning tower and said another turning tower has at least four said turning bar levels.

12. A printing arrangement comprising:

a printing press;

a first turning tower with a plurality of turning bars arranged in a plurality of turning bar planes for receiving a first printed web in a first direction and for guiding a plurality of printing webs one over the other;

a second turning tower arranged substantially in a line with respect to said first turning tower in said first direction of the first printed web entering said first turning tower, said second turning tower including a plurality of turning bars in a plurality of planes, said second turning tower receiving a second printed web and guiding a second plurality of printing webs one over the other.

13. The turning tower arrangement in accordance with claim 12, further comprising:

at least one guide member arranged on a side of said second turning tower facing away from said first turning tower in a direction of web intake, said at least one guide member being provided as a bay window device for said first turning tower; and cutting means for the lengthwise cutting of the web provided, on turning towers which face away from one another.

14. The turning tower arrangement in accordance with claim 12, further comprising a third turning tower arranged between said first turning tower and said second turning tower in a direction of web intake.

15. The turning tower arrangement in accordance with claim 13, wherein said cutting means is arranged in front of said respective turning tower and said second turning towers in the direction of web entry for cutting the web lengthwise.

16. The turning tower arrangement in accordance with claim 15, further comprising guide members arranged on a side of said second turning tower facing away from said turning tower in a direction of web intake.

17. The turning tower arrangement in accordance with claim 12, wherein said first turning tower and said second turning tower are followed by at least one former each in a direction of the webs leaving the associated tower;

said turning bar planes are spaced in a vertical direction.

18. The turning tower arrangement in accordance with claim 12, wherein at least one of said first turning tower and said second turning tower has a number of said turning bar planes at least sufficient for guiding all partial webs formed from a web having the maximum width for the particular printing press one over the other.

19. The turning tower arrangement in accordance with claim 12, wherein said printing press has the width of four plates wherein:

a) at least two printed webs enter the turning tower arrangement; and b) each of said turning tower and said second turning tower has at least four said turning bar planes.

20. The turning tower arrangement in accordance with claim 12, wherein said printing press has the width of six plates and wherein:

a) at least two printed webs enter the turning tower arrangement; and b) each of said turning tower and said second turning tower has at least four said turning bar planes.

* * * * *